US005960590A

United States Patent [19]

Hutchison

[11] Patent Number: 5,960,590

[45] Date of Patent: Oct. 5, 1999

[54] GUTTER PIPE

[76] Inventor: David P. Hutchison, 1889 Carleton St., Redding, Calif. 96002

[21] Appl. No.: 09/042,070

[22] Filed: Mar. 13, 1998

Related U.S. Application Data

[60] Provisional application No. 60/040,930, Mar. 17, 1997.

[51] Int. Cl.[6] ..... E04D 13/00

[52] U.S. Cl. ..... 52/11; 52/12; 52/14; 210/474

[58] Field of Search ..... 52/11, 12, 14, 52/15; 405/43, 45; 210/474

[56] References Cited

U.S. PATENT DOCUMENTS

| | | | |
|---|---|---|---|
| 939,838 | 11/1909 | Hensler . | |
| 2,120,395 | 6/1938 | Dean . | |
| 2,533,402 | 12/1950 | Schmitz, Jr. . | |
| 3,374,634 | 3/1968 | Fochler . | |
| 3,378,673 | 4/1968 | Hopper . | |
| 3,440,822 | 4/1969 | Hegler | 405/45 |
| 3,507,396 | 4/1970 | Homa . | |
| 3,681,925 | 8/1972 | Schmunk et al. . | |
| 3,699,684 | 10/1972 | Sixt | 61/11 |
| 3,821,512 | 6/1974 | Stanford | 52/11 |
| 3,830,373 | 8/1974 | Sixt et al. | 210/489 |
| 4,038,519 | 7/1977 | Foucras . | |
| 4,043,527 | 8/1977 | Franzmeier | 52/11 |
| 4,110,597 | 8/1978 | Elmore . | |
| 4,113,818 | 9/1978 | Drossbach . | |
| 4,188,154 | 2/1980 | Izatt | 405/43 |
| 4,214,147 | 7/1980 | Kraver . | |
| 4,308,696 | 1/1982 | Schroeder | 52/11 |
| 4,401,880 | 8/1983 | Eizenhoefer | 52/11 |
| 4,769,526 | 9/1988 | Taouil | 52/11 |
| 4,905,427 | 3/1990 | McPhalen | 52/12 |
| 4,930,936 | 6/1990 | Hegler et al. | 405/43 |
| 4,950,103 | 8/1990 | Justice | 405/45 |
| 5,103,601 | 4/1992 | Hunt | 52/12 |
| 5,107,635 | 4/1992 | Carpenter . | |
| 5,242,591 | 9/1993 | Beechert et al. | 210/474 |
| 5,391,858 | 2/1995 | Tourangeau et al. . | |
| 5,409,602 | 4/1995 | Sorenson | 210/474 |
| 5,531,543 | 7/1996 | Johnsen | 52/11 |

FOREIGN PATENT DOCUMENTS 1 509 127 8/1969 Germany .

OTHER PUBLICATIONS

"Gutter Screen Said To Eliminate Drain Problems", Weather Products Corporation and Gutter Screen Mfg. Co., advertisement in American Roofer, undated.

*Primary Examiner*—Carl D. Friedman
*Assistant Examiner*—Dennis L. Dorsey
*Attorney, Agent, or Firm*—John P. O'Banion

[57] ABSTRACT

A rain gutter pipe comprising a tubular member (12), a plurality of ridges (14) disposed circumferentially thereon, a plurality of valleys (16) defined between the ridges (14) and a plurality of apertures (18) disposed circumferentially around the valleys (16). The gutter pipe is inserted into the entire length of a rain gutter system (24), and an opening (34) is provided adjacent the downspout (36). The gutter pipe is flexible, associated straight couplers (44) allow for connecting multiple runs for greater overall lengths, and associated angle couplers (48) of various configurations are used to connect runs of gutter pipe together at varying angles. Rain water flows through gutter pipe and into the downspout even when accumulated debris covers the surface of gutter pipe. The gutter pipe can also be used on flat roofs to achieve the same objectives. Resistive heating wire (60) can also be wrapped around the gutter pipe to melt snow or ice accumulated thereon.

26 Claims, 6 Drawing Sheets

GUTTER PIPE

CROSS-REFERENCE TO RELATED APPLICATIONS

This application claims priority from U.S. provisional application Ser. No. 60/040,930 filed on Mar. 17, 1997.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention pertains generally to roof drainage systems, and more particularly to water-permeable pipe placed either within a rain gutter for preventing debris or snow from clogging the rain gutter, or atop a flat roof to minimize snow accumulation, while allowing water to freely flow through the pipe.

2. Description of the Background Art

A conventional means of ensuring unimpeded flow of water through a rain gutter include various forms of screen material placed on top over the rain gutter opening, thereby preventing entry of leaves, twigs and other debris from entering the gutters and obstructing the flow of water. These screens also prevent accumulation of snow from the gutter, and possibly the collapse of the gutter due to the increase weight of accumulated snow. The problem encountered with such screens, however, is that over the course of time, leaves, twigs and other debris tend to settle and accumulate over the screen, preventing water from even entering the rain gutters, and running off the top of the accumulated pile. Without regular cleaning, the accumulated pile becomes unsightly, and the weight of the pile eventually causes the gutter to collapse from the roof altogether.

Another means for preventing accumulation of unwanted debris and/or snow from a rain gutter is to place a liquid-permeable, elongated member into and along the length of the gutter. The elongated material prevents entry of unwanted material into the gutter and allows water to flow through the gutter. The problem with this approach, however, is that the accumulation of material over the permeable surface of the elongated member eventually blocks water flow into the member and thus, prevents flow of the water through the gutter.

Therefore, there exists a need for an apparatus that prevents the gathering and accumulation of debris or snow within a gutter or on a flat roof, while allowing the flow of water through the apparatus even when its surface is covered with debris, snow or the like. The present invention satisfies these needs, as well as others, and generally overcomes the deficiencies found in conventional approaches.

BRIEF SUMMARY OF THE INVENTION

The present invention generally pertains to a water-permeable tubular member that can be placed either within and along the entire length of a rain gutter or atop a flat roof. The tubular member includes ridges disposed circumferentially around the member, valleys defined between the ridges, and apertures circumferentially disposed within the valleys.

The tubular member, when placed into a rain gutter, substantially fills the space within the gutter, thereby preventing the entry of debris, snow or unwanted materials into the rain gutter. Except for the apertures disposed within the valleys of the tubular members, the drainage channels created by the tubular members are essentially sealed. Various fittings and couplings can be used to configured to accommodate angles or bends within the rain gutter system. Water flows through the gutter by first flowing through the apertures and into the tubular members and is drained away by the downspout in the rain gutter.

The ridges provide flexibility to the tubular member and ensure that, even if the tubular member is covered with wet leaves or debris, water entering the rain gutter will be able to filter through the debris and run down the channels into the apertures, which eventually leads to the downspout. The tubular member is sufficiently rigid to prevent collapse under wet debris or snow and is flexible enough to allow for easy installation into a rain gutter. The tubular member can be wrapped with resistive wire which, when energized, produces heat to melt any snow or ice accumulated in or on the tubular member.

The invention can also be used with structures having flat roofs as part of a drainage safety system. Where water cannot otherwise freely drain away from roof due to obstructions from slush, ice, snow or debris accumulated on the roof, water will enter the tubular members and flow to a downspout or drain.

An object of the invention is to prevent unwanted debris from entering and clogging a rain gutter, while allowing water to flow through the gutter.

Another object of the invention is to provide a rain gutter pipe system that can be easily installed into an existing rain gutter network.

Another object of the invention is to provide a rain gutter pipe system that can accommodate turns and bends within a rain gutter system.

Yet another object of the invention is to provide a rain gutter pipe system capable of being used on flat roofs independent of a rain gutter system.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Referring more specifically to the drawings, for illustrative purposes the present invention is embodied in the apparatus generally shown in FIG. 1 through FIG. 8. It will be appreciated that the apparatus may vary as to configuration and as to details of the parts without departing from the basic concepts as disclosed herein.

Figure 1:
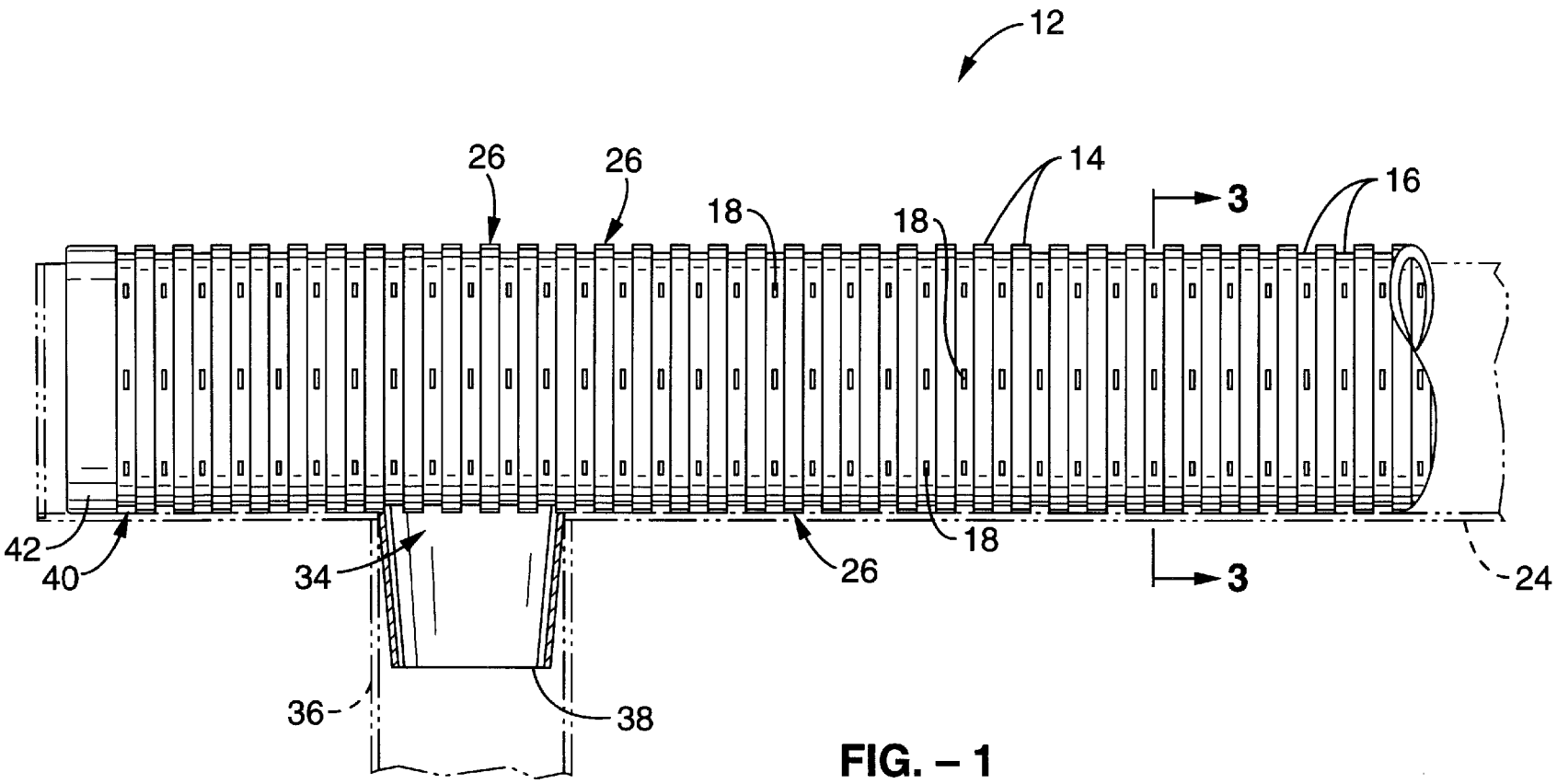
FIG. 1 is a side elevation view of a preferred embodiment of a tubular member in accordance with the present invention positioned in a rain gutter and adjacent to a downspout shown in phantom.
Figure 2:
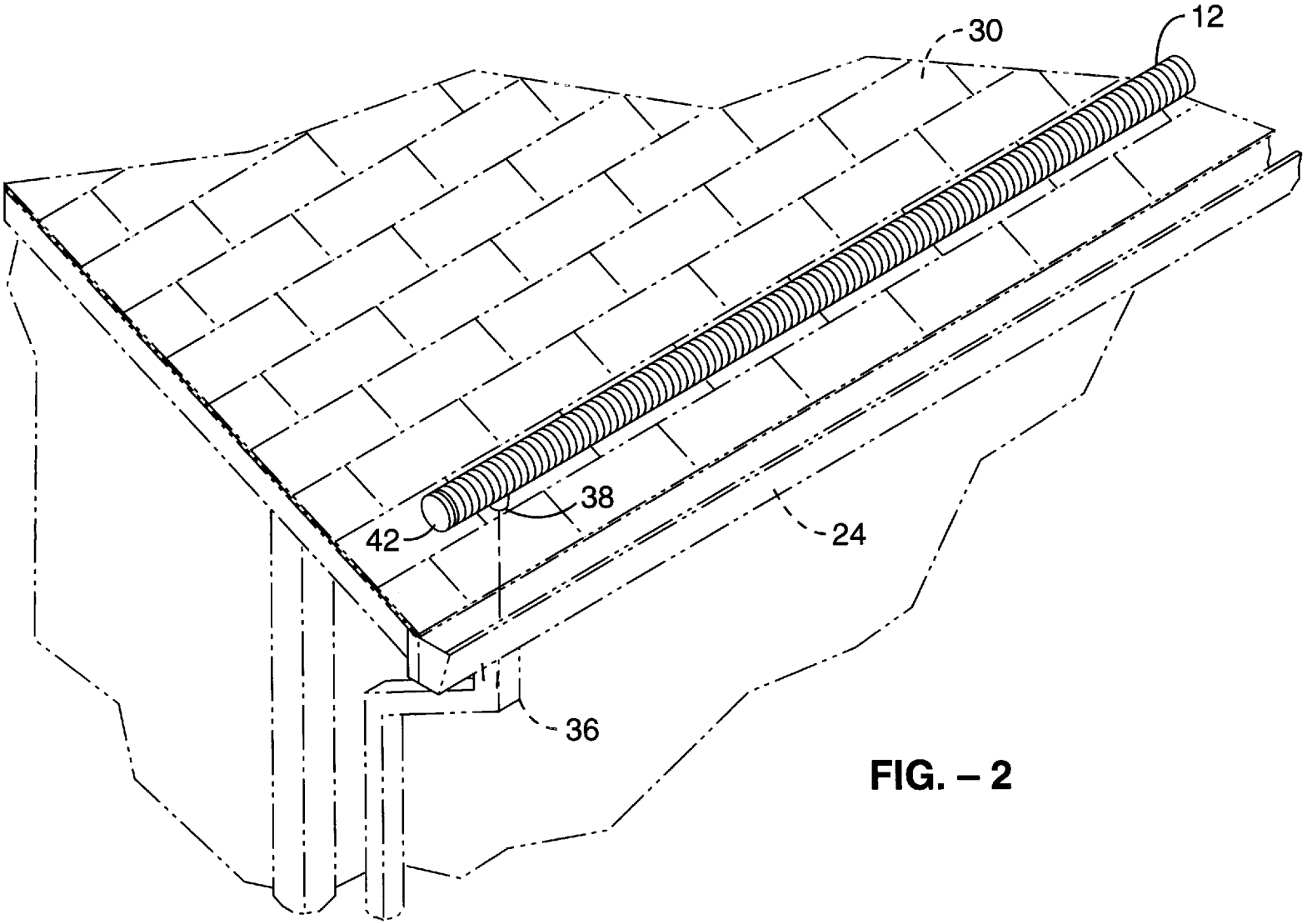
FIG. 2 is an exploded perspective view of the tubular member shown in FIG. 1 positioned adjacent to a portion of a building, roof and rain gutter shown in phantom.
Figure 3:
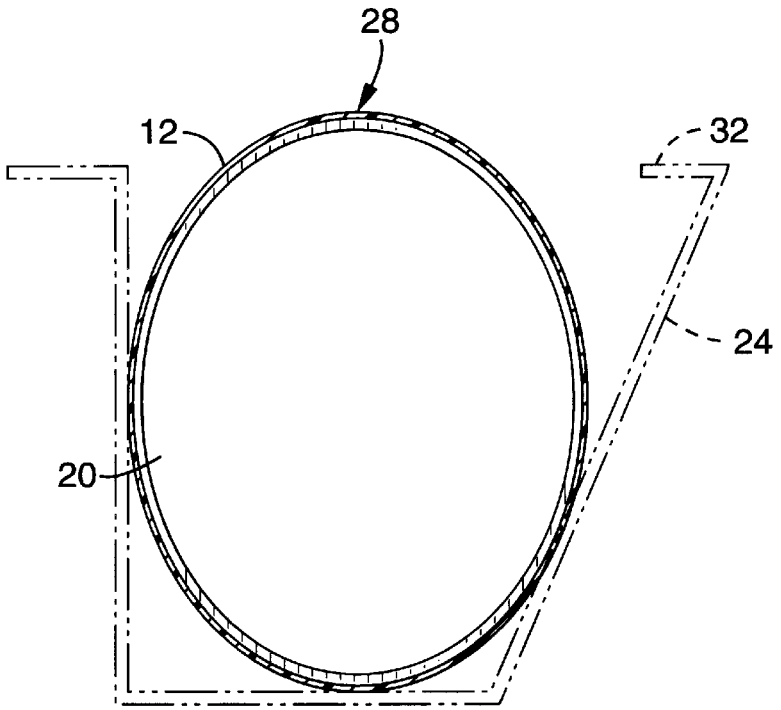
FIG. 3 is a cross-sectional view of the tubular member shown in FIG. 1 taken through line 3—3 and showing a full gutter section, the section indicator in FIG. 1 showing section direction only.

Referring first to FIG. 1 through FIG. 3, a gutter pipe apparatus in accordance with the present invention preferably comprises a tubular member 12 having a plurality of ridges 14, a plurality of valleys 16, and a plurality of apertures 18. Ridges 14 are disposed circumferentially around tubular member 12, valleys 16 are bordered by ridges 14 and are disposed therebetween, and apertures 18 are disposed within valleys 16 circumferentially around tubular member 12.

Tubular member 12 can have either an oval 20 or round cross-section 22, however an oval cross-section 20 allows for a more optimum fit into a rain gutter 24 as shown in FIG. 3. The preferred inner diameter of tubular member 12 ranges from approximately two inches to approximately six inches, varying with the specific size of rain gutter 24 and the amount of water to be removed. For installation in most rain gutters, oval cross-section 20 would have a minor diameter of approximately 2¾ inches and a major diameter of approximately a three inches.

Ridges 14 are preferably spaced apart at approximately ⅝ inch intervals and valleys 16 are preferably approximately ¼ inch below the top 26 of ridges 14. Within each valley 16 are a preferred maximum of twelve circumferentially-disposed apertures 18, with eight being the preferred number of apertures 18. The approximately ¼ inch recess of apertures 18 from the top 26 of ridges 14 prevent blockage of apertures 18 when tubular member 12 is covered with debris (not shown) by maintaining debris away from apertures 18. In the preferred embodiment, apertures 18 comprise slits, although holes of approximately ¼ diameter inch will also suffice. Slits have an advantage over holes as slits tend not to clog as easily. By the same token, since apertures 18 are located within valley 16, water entering rain gutter 24 would be able to filter through accumulated debris and run down valley 16 and into apertures 18.

When tubular member 12 is inserted into the entire length of rain gutter 24, only water can enter tubular member 12. Debris, leaves, snow and other contaminants may still collect and accumulate on top 28 of tubular member 12, but do not interfere with water drainage from a roof 30. Ideally, top 28 of tubular member 12 extends above upper surface 32 of rain gutter 24 as shown in FIG. 3 so that debris that accumulates on top 28 of tubular member 12 will thereafter be blown away by the wind after they dry.

Tubular member 12 is preferably fabricated from a polyethylene plastic, or like material, capable of withstanding wide ranges of temperature fluctuations. In cold climates where snowing and freezing are regular occurrences, inserting of tubular member 12 into rain gutter 24 replaces the slush and ice that can accumulate and eventually collapse rain gutter 24 from roof 30.

As can be seen in FIG. 1, an opening 34 is provided in tubular member 12 after installation within a rain gutter 24 adjacent the downspout 36 of rain gutter 24 to allow water to flow into downspout 36. To maintain alignment between opening 34 and downspout 36, a fitting 38 can be inserted into opening 34 of tubular member 12 and directed into downspout 36. Tubular member 12 can be configured at any angle to conform to turns within rain gutter 24. The terminal end 40 of tubular member 12 within rain gutter 2 is covered with an end cap 42.

Figure 5:
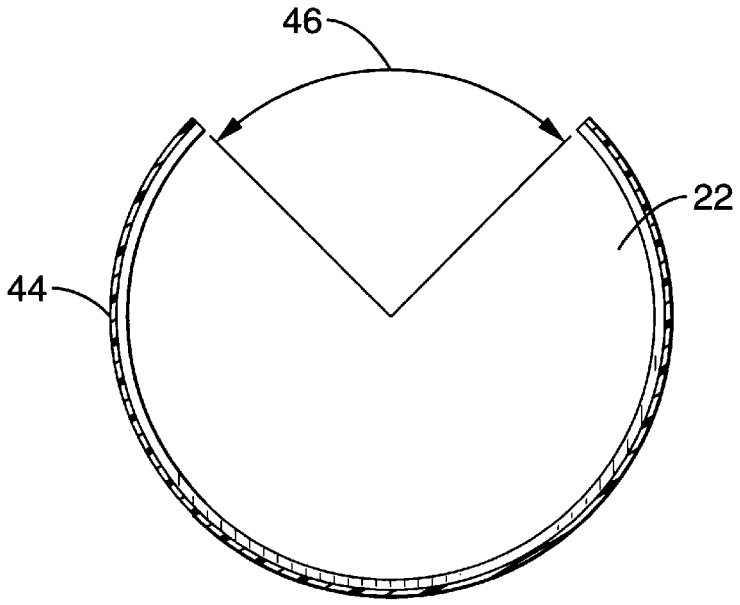
FIG. 5 is a cross-sectional view of the coupler shown in FIG. 4 taken through line 5—5.
Figure 4:
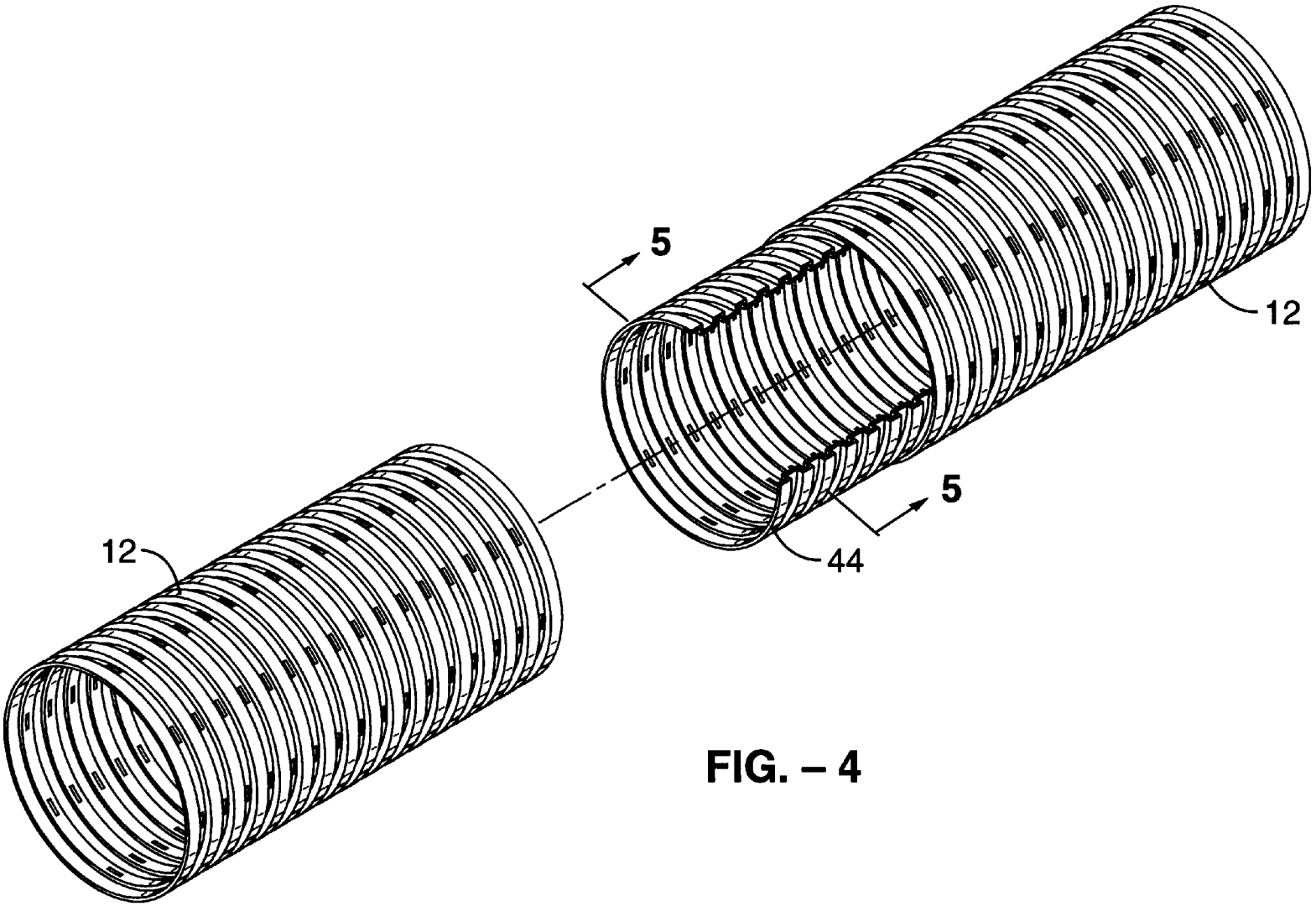
FIG. 4 is a partial exploded perspective view of two tubular members of the present invention and a coupler employed for joining the tubular members.
Figure 6:
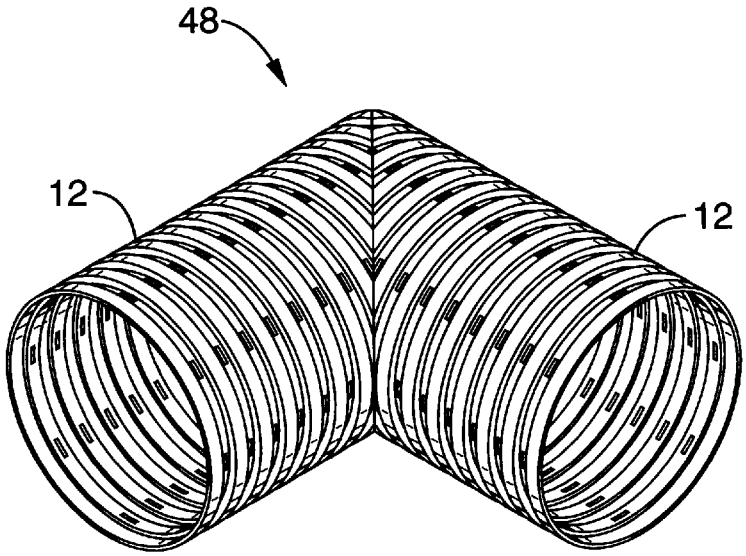
FIG. 6 is perspective view of a right angle connector in accordance with the present invention.

Referring also to FIG. 4 and FIG. 5, shorter sections of tubular member 12 can be joined together by couplers 44, to extend the overall length as required. Coupler 44 has a section 46 removed therefrom, as seen in FIG. 5, so that the outer diameter of coupler 44 can be reduced to allow insertion of coupler 44 between adjoining sections of tubular members 12. Referring also to FIG. 6, a right-angled connector 48 can be fabricated from tubular member 12 to accommodate any turn or bend in rain gutter 24, and it will be appreciated by those skilled in the art that connector 40 can also be fabricated using tubular member 12 into any angle other than 90°.

Figure 7:
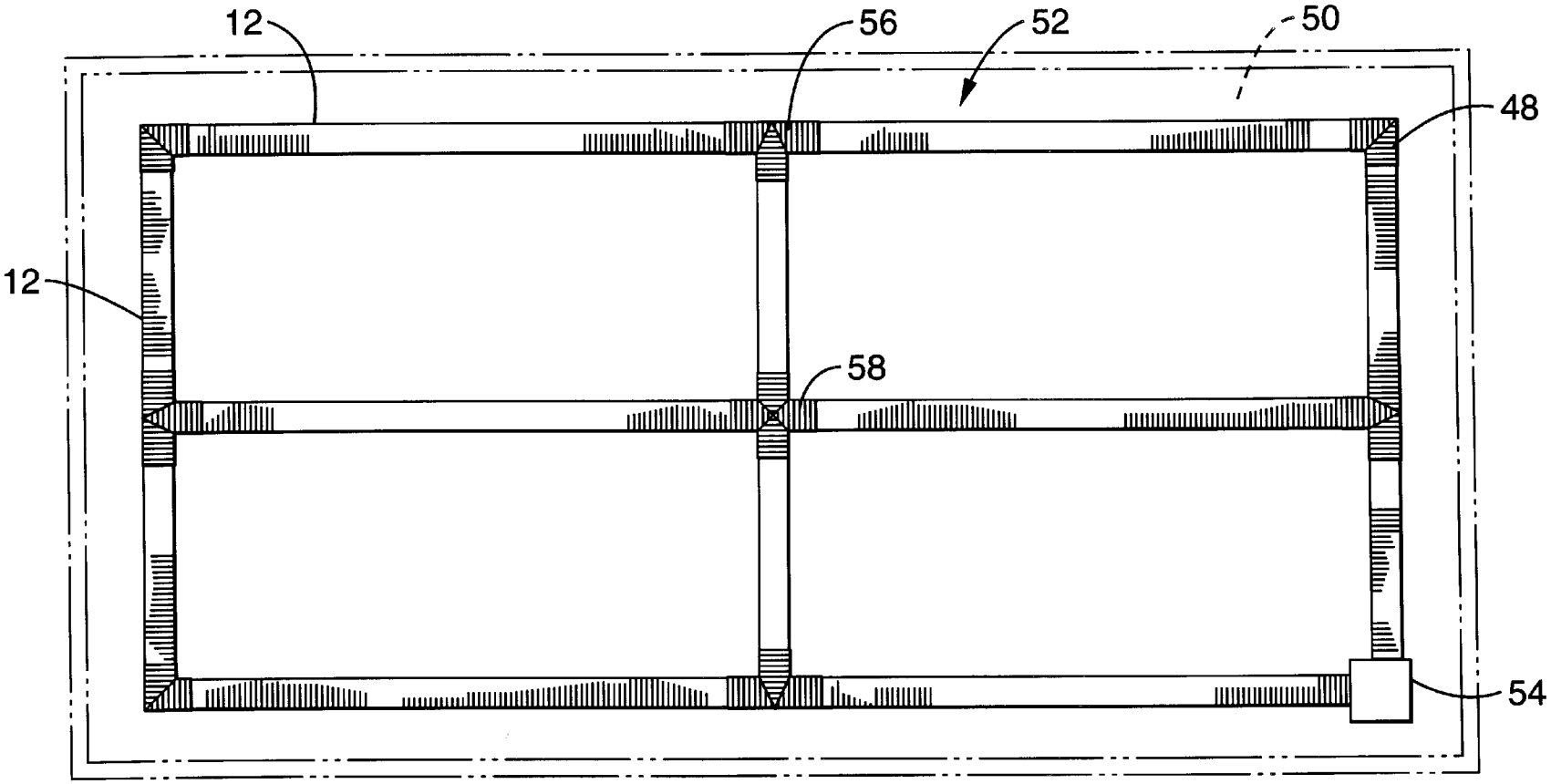
FIG. 7 is a plan view showing a network of tubular members configured for a flat roof shown in phantom.

Referring now to FIG. 7, tubular member 12 can also be independently used on flat roofs 50 without rain gutters. The flat roof configuration 52 is also sealed and functions similarly to that inserted into rain gutter 24, by allowing water to enter tubular member 12 and travel to a drain 54. Flat roof configuration 52 is a safety system for drainage of water that is otherwise unable to drain freely off flat roof 50 because it is trapped by slush, ice, snow or debris. Tubular sections 12 would be secured to flat roof 50 at specified intervals with pipe straps and lags (not shown) screwed into flat roof 50. It can be seen that T-connectors 56 and cross-connectors 58 can be used as required to form flat roof configuration 52.

Figure 8:
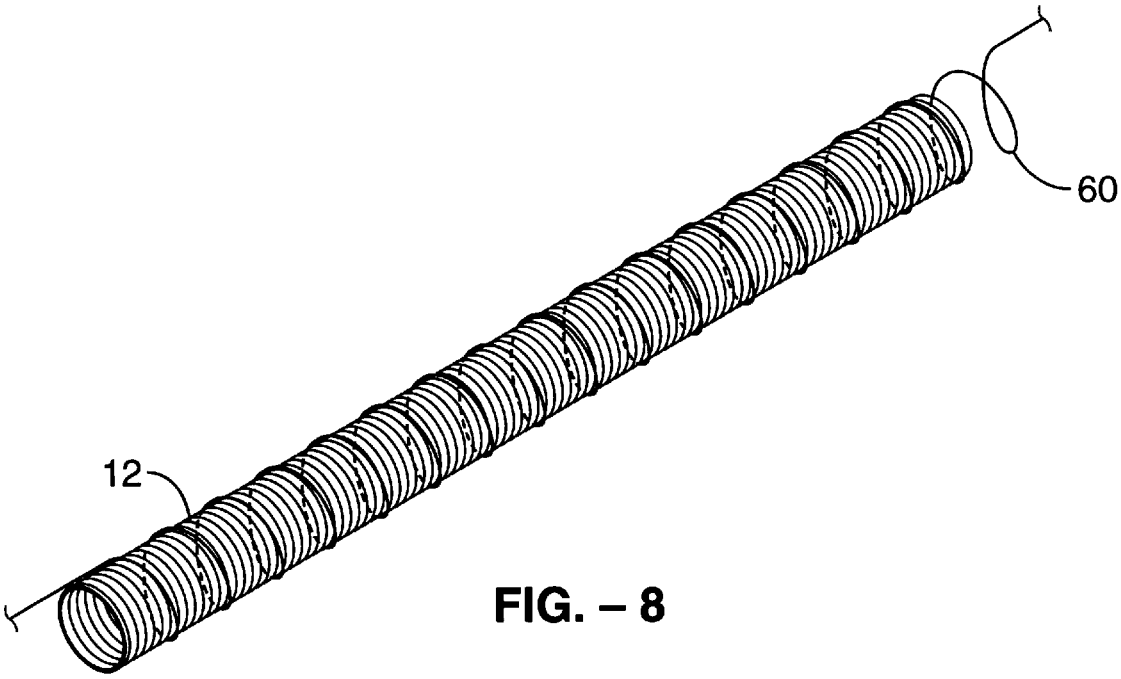
FIG. 8 is perspective view of a tubular member wrapped with a resistive wire.

Additional features of the invention are especially beneficial in cold climates. First, the tubular members 12 are preferably black in color. Therefore, they retain heat and, if the temperature drops below 30°, water can still drain through tubular members 12. Referring also to FIG. 8, a resistive heating wire 60 can be either coiled around, as shown, or stretched across or run inside tubular member 12 over the entire length of a tubular member 12. When energized, resistive wire 60 would generate sufficient heat to melt snow or ice accumulated on or around tubular members 12. Power to resistive wire can be supplied from household electric current or batteries (not shown). Resistive wire 60 can be self-regulating such that it automatically activates when the temperature reaches approximately 30° and moisture is present. Ideally, temperature within tubular members 12 should be maintained at approximately 50° so water can flow through at all times. Second, as can be seen in FIG. 3, since top 28 of tubular member 12 protrudes and arcs over upper surface 30 of rain gutter 24, this has the effect of forcing snow that has accumulated on rain gutter 24 to slide off, thus preventing the weight of accumulated snow from damaging or tearing rain gutter 24 away from its mount. Moreover, tubular member 12 fills the space where snow otherwise would accumulate. Thus, there would never be an excess of snow accumulation. Third, tubular member 12 is a drain line that only allows water within, not leaves, debris or even snow. On flat roofs 50, water from accumulated and melted snow can flow continually flow through, again, preventing an excess accumulation of snow thereon.

Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. A rain gutter system, comprising:

(a) a rain gutter having a channel and a drainage outlet; and (b) a tubular member positioned in said channel, said tubular member having a plurality of ridges disposed circumferentially around said tubular member, a plurality of valleys defined by and between said ridges, and a plurality of apertures disposed circumferentially within said valleys;

(c) wherein water in said rain gutter enters said tubular member through said apertures and flows through said tubular member to said drainage outlet, and wherein said tubular member prevents blockage of water flow from accumulation of debris or snow.

2. A system as recited in claim 1, wherein said tubular member is connected to said drainage outlet.

3. A system as recited in claim 1, wherein said apertures comprise slits.

4. A system as recited in claim 1, wherein said tubular member has a generally oval cross-section.

5. A system as recited in claim 1, wherein said tubular member has a generally circular cross-section.

6. A system as recited in claim 1, wherein said tubular member is flexible.

7. A system as recited in claim 1, wherein said tubular member is wrapped by resistive wire capable of producing heat upon flow of electricity therethrough.

8. A method of preventing blockage of water flowing through a rain gutter from accumulation of debris or snow, said rain gutter having a channel and a drainage outlet, comprising the steps of inserting a tubular member into said channel, wherein said tubular member includes a plurality of ridges disposed circumferentially around said tubular member, a plurality of valleys defined by and between said ridges, and a plurality apertures disposed circumferentially within said valleys, wherein water in said rain gutter enters said tubular member through said apertures and flows through said tubular member to said drainage outlet, and wherein said tubular member prevents blockage of water flow from accumulation of debris or snow.

9. A method as recited in claim 8, further comprising the steps of connecting said tubular member to said drainage outlet.

10. A method as recited in claim 8, wherein said apertures comprise slits.

11. A method as recited in claim 8, wherein said tubular member has a generally oval cross-section.

12. A method as recited in claim 8, wherein said tubular member has a generally circular cross-section.

13. A method as recited in claim 8, wherein said tubular member is flexible.

14. A method as recited in claim 8, wherein said tubular member is wrapped by resistive wire capable of producing heat upon flow of electricity therethrough.

15. A rain gutter system, comprising:

(a) a rain gutter having a channel and a drainage outlet; and (b) a tubular member positioned in said channel and connected to said drainage outlet, said tubular member having a plurality of ridges disposed circumferentially around said tubular member, a plurality of valleys defined by and between said ridges, and a plurality of apertures disposed circumferentially within said valleys;

(c) wherein water in said rain gutter enters said tubular member through said apertures and flows through said tubular member to said drainage outlet, and wherein said tubular member prevents blockage of water flow from accumulation of debris or snow.

16. A system as recited in claim 15, wherein said apertures comprise slits.

17. A system as recited in claim 15, wherein said tubular member has a generally oval cross-section.

18. A system as recited in claim 15, wherein said tubular member has a generally circular cross-section.

19. A system as recited in claim 15, wherein said tubular member is flexible.

20. A system as recited in claim 15, wherein said tubular member is wrapped by resistive wire capable of producing heat upon flow of electricity therethrough.

21. A method of preventing blockage of water flowing through a rain gutter from accumulation of debris or snow, said rain gutter having a channel and a drainage outlet, comprising the steps:

(a) of inserting a tubular member into said channel; and (b) connecting said tubular member to said drainage outlet, wherein said tubular member includes a plurality of ridges disposed circumferentially around said tubular member, a plurality of valleys defined by and between said ridges, and a plurality of apertures disposed circumferentially within said valleys, wherein water in said rain gutter enters said tubular member through said apertures and flows through said tubular member to said drainage outlet, and wherein said tubular member prevents blockage of water flow from accumulation of debris or snow.

22. A method as recited in claim 21, wherein said apertures comprise slits.

23. A method as recited in claim 21, wherein said tubular member has a generally oval cross-section.

24. A method as recited in claim 21, wherein said tubular member has a generally circular cross-section.

25. A method as recited in claim 21, wherein said tubular member is flexible.

26. A method as recited in claim 21, wherein said tubular member is wrapped by resistive wire capable of producing heat upon flow of electricity therethrough.

* * * * *